US005096453A

United States Patent [19]

Van Meter

[11] Patent Number: 5,096,453

[45] Date of Patent: Mar. 17, 1992

[54] STUFFED TOY WITH DETACHABLE APPENDAGES

[76] Inventor: Roberta T. Van Meter, 500 No. Congress Ave., #208, West Palm Beach, Fla. 33401

[21] Appl. No.: 292,901

[22] Filed: Jan. 3, 1989

Related U.S. Application Data

[63] Continuation-in-part of Ser. No. 867,395, Aug. 29, 1986, abandoned.

[51] Int. Cl.[5] ..... A63H 3/02

[52] U.S. Cl. ..... 446/73; 446/99; 446/369; 446/390

[58] Field of Search ..... 446/71, 72, 73, 74, 446/76, 77, 97, 98, 99, 100, 101, 369, 385, 901, 390; D21/148, 157, 170

[56] References Cited

U.S. PATENT DOCUMENTS

| | | | |
|---|---|---|---|
| 858,090 | 6/1907 | Meinecke | 446/99 |
| 1,552,348 | 9/1925 | Rosenthal | 446/369 X |
| 1,756,048 | 4/1930 | Williams | 446/74 X |
| 4,208,832 | 6/1980 | Corriveau | 446/369 X |

*Primary Examiner*—Mickey Yu
*Attorney, Agent, or Firm*—Alvin S. Blum

[57] ABSTRACT

A stuffed toy has a short cylindrical body and a plurality of elongate appendages extending below the body. The appendages are readily attached and detached by a child to teach motor skills. The appendages may be color coded to matching attaching sites on the body. Matching indicia such as numbers may also be provided for educational purposes.

13 Claims, 2 Drawing Sheets

STUFFED TOY WITH DETACHABLE APPENDAGES

This application is a continuation in part of copending application Ser. No. 06/867,395 filed Aug. 29, 1986, abandoned.

This invention relates to stuffed toys and more particularly to stuffed toys having many soft, elongate detachable flexible appendages extending from the lower portion of a short, soft body.

BACKGROUND OF THE INVENTION

It has been common practice to manufacture toys that are representations of real or imaginary animals. These are often made of fabric having a plush or nap surface that is stuffed with soft material to provide a soft and cuddly plaything, such as U.S. Pat. No. Des. 175,475 issued in Aug. 30, 1955 to Oswald with braided cord appendages secured to the lower body.

This type of plaything is generally used for pleasure and comfort but has negligible educational features and no versatility in stimulating the user's imagination.

SUMMARY OF THE INVENTION

It is accordingly an object of the invention to provide a stuffed animal toy that combines the pleasure and comfort aspects of such devices with versatility and educational functions to stimulate the intellectual and motor skills of the user. The device includes a short, squat stuffed body and a plurality of elongate, soft stuffed appendages that are detachably connected to the lower portion of body by attaching means that are easily operated by a child. The body and appendages are comprised of a soft, plush or pile fabric outer coating that has been stuffed with soft material. When assembled, the configuration of the many elongate appendages and the short body is easily draped over articles or the user's body in play where it balances and remains in place easily. The child easily learns to remove and reattach the limbs to provide satisfaction in task completion and to learn coordination and motor skills with a lovable, cuddly toy. In various optional embodiments, the body may include eyes, nose, ears, pockets for teaching cards, an internal chamber, decorative embellishments and the like. Each appendage may be numerically or color coded to a specific attachment site for learning number or color matching, for example.

These and other objects, advantages and features of the invention will be understood from the following description and accompanying drawings.

DETAILED DESCRIPTION OF PREFERRED EMBODIMENTS

Figure 1:
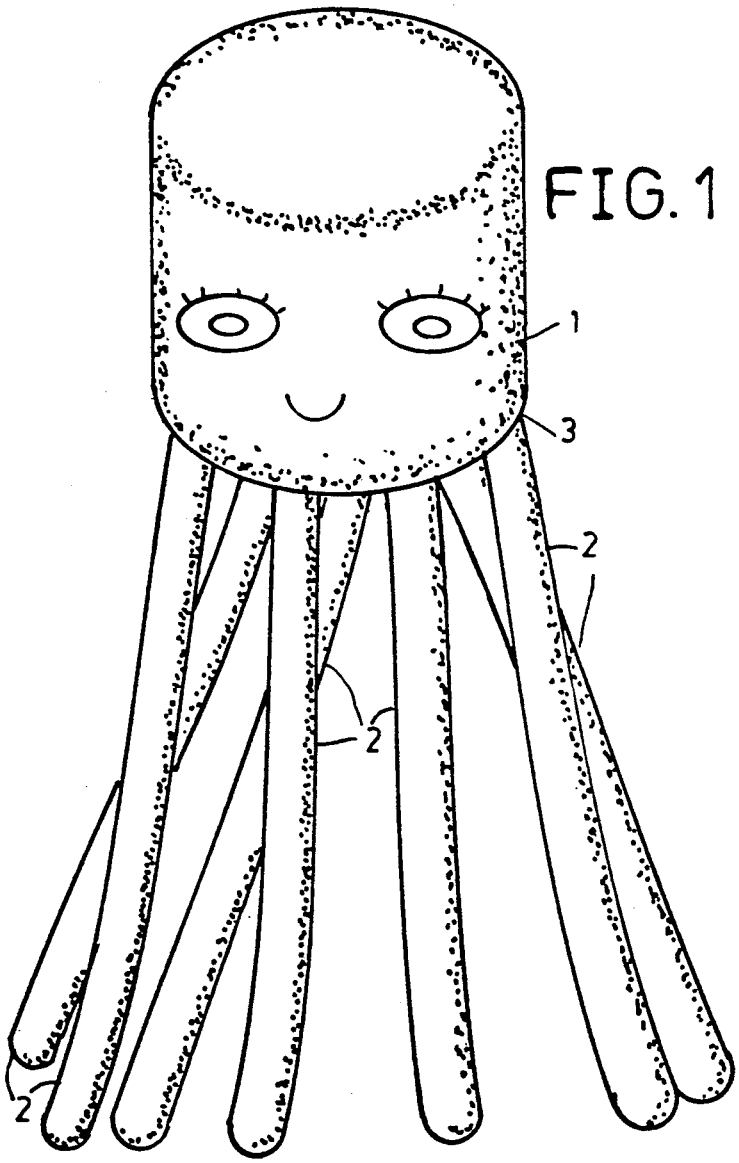
FIG. 1 is a perspective front view of the toy of the invention.
Figure 3:
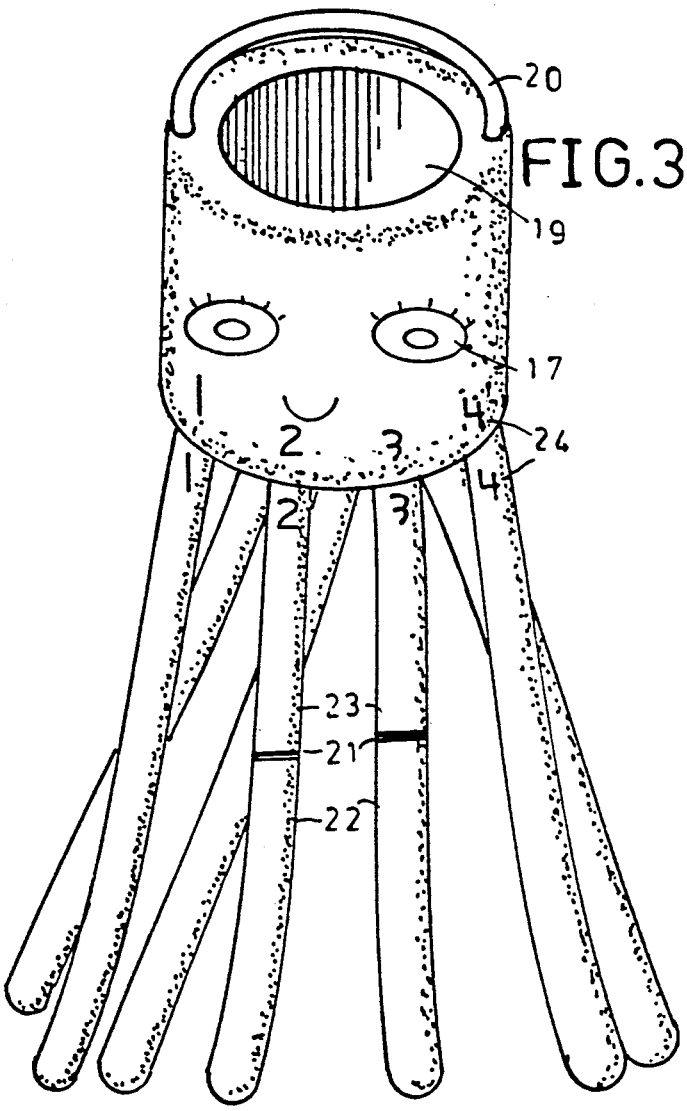
FIG. 3 is a perspective front view of the toy having a receptacle type body.
Figure 2:
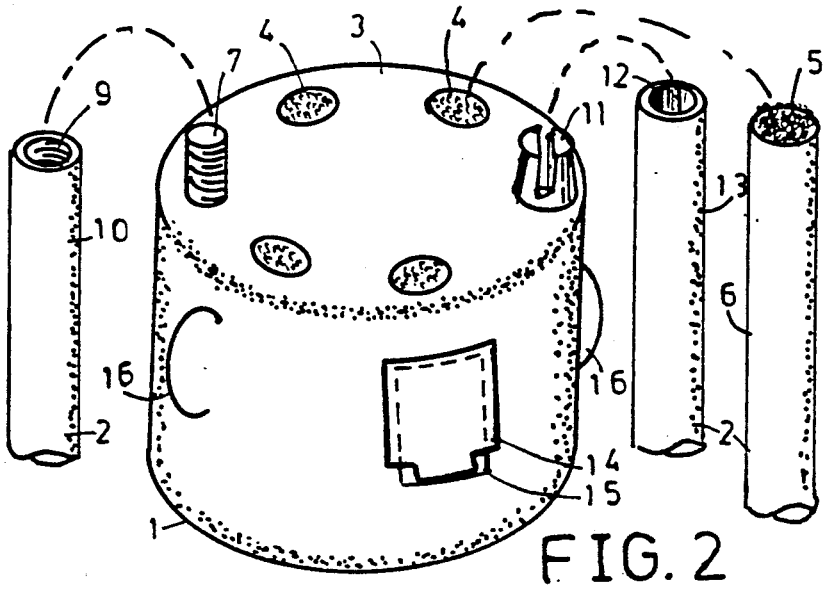
FIG. 2 is a perspective view of the underside of the toy illustrating several appendage attaching means.

Referring now first to FIG. 1, the toy of the invention includes a short, generally cylindrical body member 1 composed of a body fabric with a plush, furry, or pile surface, such as the type generally used for teddy bears and other stuffed toys, that has been stuffed with soft stuffing. A number of elongate appendages 2 are attached to the bottom edge 3 of the body 1. Each appendage is comprised of a long fabric tube that has been stuffed with a soft stuffing. The fabric tube will generally have the same texture as the body fabric. Each appendage is at least twice as long as the body 1. There are between five and ten appendages. As shown in FIG. 2, each appendage 2 is removably attached to the body 1 at the bottom edge 3 by removable attaching means that are readily operated by small children. Illustrated herein are three different attaching means that are suitable for this application. Attached to the body at attaching sites 4 are panels of hooks of the hook-and-loop fastener means well known in the art. The end of the elongate appendage 6 is covered with a panel 5 of the loops of the hook-and-loop fastener means to engage the hook panel 4 to removably attach the appendage to the body by a means readily operated by a child. Alternative attaching means are the threaded stud 7 to which appendage 10 is attached by threaded recess 9, and the spring plug 11 that engages socket 12 of appendage 2. Removing and reattaching the appendage 2 to body 1 teaches motor skills and inspires confidence in achieving a readily observed goal. The task may be further increased in difficulty by coloring each appendage and its matching site on the body by a different color or word or number 24 as shown in FIG. 3. Optionally, a pocket 14 may contain information card 15. Ears 16, eyes 17 and other features may be included. As shown in FIG. 3, the body 1 may contain a chamber 19 and a handle 20 so that it serves as a basket.

By providing long appendages and a short body, the toy when draped over a child or a structure will be well balanced and will stay in place to offer extra play and coordination opportunities. As shown in FIG. 3, each appendage may be segmented into two or more segments 22 and 23 joined together by attaching means such as disclosed above at joint 21 for further motor skill teaching and play opportunity. In that case the appendages may be permanently affixed to the body.

The above disclosed invention has a number of particular features which should preferably be employed in combination although each is useful separately without departure from the scope of the invention. While I have shown and described the preferred embodiments of my invention, it will be understood that the invention may be embodied otherwise than as herein specifically illustrated or described, and that certain changes in the form and arrangement of parts and the specific manner of practicing the invention may be made within the underlying idea or principles of the invention within the scope of the appended claims.

What is claimed is:

1. A stuffed toy combining educational and play functions, comprising:

a) a stuffed body member having a top, a bottom and sides;

b) a plurality of elongate appendages numbering between five and ten, each of said appendages formed of an elongate cylindrical tube of fabric material having a length greater than the height of said body member, said tube filled with stuffing to provide a non-rigid, readily bendable appendage, all of said appendages having a substantially uniform shape; and c) attaching means for removably attaching said appendages to said body member, each said attaching means including a first attaching element affixed to one end of said appendage and a second, complementary attaching element affixed to said bottom of said body member and not to said sides, to provide enhanced draping and balancing of said toy, in which said body member includes a chamber with an open top.

2. The toy according to claim 1, in which said body member includes a handle.

3. A stuffed toy combining educational and play functions, comprising:

a) a stuffed body member having a top, a bottom and sides;

b) a plurality of elongate appendages numbering between five and ten, each of said appendages formed of an elongate cylindrical tube of fabric material having a length greater than the height of said body member, said tube filled with stuffing to provide a non-rigid, readily bendable appendage, all of said appendages having a substantially uniform shape; and c) attaching means for removably attaching said appendages to said body member, each said attaching means including a first attaching element affixed to one end of said appendage and a second, complementary attaching element affixed to said bottom of said body member and not to said sides, to provide enhanced draping and balancing of said toy, and in which said appendages are divided into segments and said segments are joined together by said attaching means.

4. A stuffed toy combining educational and play functions comprising:

a) a stuffed body member having a top, a bottom, and sides;

b) a plurality of elongate appendages numbering between five and ten affixed to said bottom of said body member, each of said appendages formed of an elongate tube of fabric material having a length at least the height of said body member, said tube filled with stuffing to provide a non-rigid, readily bendable appendage; and c) each of said appendages divided into a plurality of segments, said segments removably joined together by attaching means.

5. The toy according to claim 4, in which said attaching means includes hook-and-loop fastening means.

6. The toy according to claim 4, in which said attaching means includes threaded fastening means.

7. The toy according to claim 4, in which said attaching means includes plug-and-socket fastening means.

8. The toy according to claim 4, in which said body member includes a chamber, said chamber having an opening at said top of said body member, said opening occupying at least half of the area of said top.

9. The toy according to claim 4, in which said body member includes a handle.

10. The toy according to claim 9, in which said body member includes a handle.

11. A stuffed toy combining educational and play functions, comprising:

a) a cylindrically-shaped, stuffed body member having a top, a bottom and sides;

b) a chamber formed in said body member, said chamber having an opening at said top of said body member, said opening occupying at least half the area of said top, said chamber of a substantially cylindrical shape and having a closed bottom end;

c) a plurality of elongate appendages, numbering between five and ten, attached to said bottom of said body member, each of said appendages formed of an elongate tube of fabric material having a length greater than the height of said body member, said tube filled with stuffing to provide a non-rigid, readily bendable appendage.

12. The toy according to claim 11, in which a carrying handle is connected to said body member.

13. The toy according to claim 11, in which said appendages are attached to said body member by removable attaching means to enhance said play and educational functions of said toy.

* * * * *